United States Patent [19]

Shumaker

[11] 4,358,240

[45] Nov. 9, 1982

[54] ASYMMETRIC BACKHOE

[75] Inventor: John F. Shumaker, Mt. Pleasant, Iowa

[73] Assignee: J. I. Case Company, Racine, Wis.

[21] Appl. No.: 218,455

[22] Filed: Dec. 19, 1980

[51] Int. Cl.[3] ..... E02F 3/38

[52] U.S. Cl. ..... 414/694; 414/722; 37/DIG. 19

[58] Field of Search ..... 414/685, 687, 694, 695, 414/722, 727; 37/DIG. 19

[56] References Cited

U.S. PATENT DOCUMENTS

| | | | |
|---|---|---|---|
| 3,536,217 | 10/1970 | Pilch | 414/694 |
| 4,074,821 | 2/1978 | Long | 414/694 |
| 4,272,222 | 6/1981 | Davis | 414/694 |

FOREIGN PATENT DOCUMENTS

| | | | |
|---|---|---|---|
| 207810 | 12/1967 | U.S.S.R. | 414/694 |

*Primary Examiner*—Robert J. Spar

*Assistant Examiner*—Terrance L. Siemens

*Attorney, Agent, or Firm*—Dressler, Goldsmith, Shore, Sutker & Milnamow, Ltd.

[57] ABSTRACT

A backhoe arrangement is described wherein overcenter forward movement of the boom and boom cylinder provides a transport configuration for the backhoe, and the backhoe operator's view of the bucket is enhanced. A swing tower is attached to the rear of the machine and serves as a support that embraces an asymmetrically mounted or offset boom assembly wherein the longitudinal axis of the boom and the longitudinal axis of the hydraulic actuator operating the boom are offset from the vertical axis of rotation of the swing tower. The boom hydraulic actuator flanks the boom in a clearance relationship that permits the boom to assume a substantially vertically directed neutral intermediate position. An offset boom and actuator improves the center of gravity of the backhoe and allows the boom actuator to be protected by the boom.

10 Claims, 6 Drawing Figures

ASYMMETRIC BACKHOE

TECHNICAL FIELD

This invention relates to power driven shovels and, more particularly, it is concerned with a backhoe mechanism adapted to be mounted at the rear end of a tractor or similar machine in such a manner as to improve the overall balance and handling of the tractor and the tractor operator's view of the backhoe bucket when it is placed in operation.

BACKGROUND OF THE INVENTION

In the conventional design of the backhoe, there is a transport position that is characterized by a generally vertically and slightly rearwardly extending boom carrying a folded dipper stick as close as possible to the boom so as to position the center of gravity of the backhoe as near as possible to the rear end of the tractor or machine upon which it is mounted. Typically the center of gravity of the backhoe is approximately 42 inches to the rear of the mounting pivots for the swing tower. This relationship is not conductive to stability and handling especially when the backhoe is moved at high speeds over the open road.

One particular advanced backhoe design incorporates an arrangement wherein the center of gravity for the backhoe is substantially closer to the rear of the tractor upon which it is mounted. That design incorporates an "overcenter movement" of the hydraulic actuator or boom cylinder manipulating the boom when the boom is swung to its transport position. In the transport position, the backhoe has a generally vertically and slightly forwardly extending boom held in a "knee lock" by the boom cylinder which has gone overcenter. This design has received wide acceptance by the industry and is the subject of U.S. Pat. No. 3,376,984 which is assigned to the assignee of the present invention. Although the aforementioned backhoe design by Long represents a significant improvement, further improvements in efficiency and productivity should be possible.

When a backhoe implement is attached to the rear end of a tractor or similar machine, the tractor operator reverses his position on the tractor to operate the backhoe so as to face the rear of the tractor where the controls for the backhoe implement are mounted. Since the shovel or scoop end of the backhoe is pivoted so as to fold towards the dipper stick and since the dipper stick is pivoted to fold towards the boom of the backhoe, the boom effectively obscures the tractor operator's view of the dipper stick, and more significantly, the inside of the bucket.

Moreover, it has been conventional practice to operate the boom of the backhoe by hydraulic actuators or cylinders which are positioned to either side of the boom. Thus, for the most part the tractor operator's direct line of sight to the bucket is shielded by the boom and the boom cylinders. For example, the overall width of the backhoe boom is generally about 6 inches and the overall width of each hydraulic actuator or cylinder is on the order of 4.5 inches. Thus, in ordinary backhoes, a barrier of approximately 15 inches is interposed between the backhoe operator and the bucket.

There are many times during the operation of a backhoe when the backhoe operator's view of the bucket is crucial. This is particularly true when the bucket is being manipulated at close quarters to another worker or helper or when the backhoe bucket is being moved or positioned at closes quarters to equipment or scaffolding which could be easily damaged due to movement of the bucket.

In addition, the conventional practice of flanking the boom by two hydraulic actuators or cylinders can lead to maintenance problems and equipment difficulties. This is true because the hydraulic actuators for the backhoe boom are relatively weak compared to the boom. This is particularly true when the hydraulic actuators are fully extended and a force is imposed between its ends that is generally perpendicular to the longitudinal axis of the actuator. This is an inherent characteristic of hydraulic actuators because they are used to produce force in the direction of their longitudinal axis. The only resistance against motion perpendicular to the longitudinal axis of the actuator is that provided by the seals on the piston and those between the piston rod and the cylinder. Comparatively speaking, the boom is a relatively strong structure and can easily resist forces or thrusts imposed laterally on the boom. Thus, if the boom is flanked by two hydraulic actuators, it cannot be used to protect those actuators from lateral forces such as those which would be experienced when the boom is inadvertently swung against the walls of a deep narrow trench.

Finally, it should be appreciated that any reduction in weight, any simplification in the manner in which the various components of the backhoe are linked together, and any improvement of the overall design of the backhoe would go far to reduce the production costs of the backhoe and the expense of maintaining the backhoe while improving the overall productively of the machine. A design change that accomplishes all of these objections would be well accepted by the industry.

SUMMARY OF THE INVENTION

In accordance with the present invention, a backhoe arrangement is provided wherein the center of gravity of the backhoe is brought closer to the rear end of the tractor or machine upon which it is mounted. Moreover, by asymmetrically positioning the backhoe boom and boom cylinder in relationship to the vertical axis of the swing tower, the overall field of view of the backhoe operator is improved. In addition, since only one laterally disposed hydraulic actuator is used to operate the boom, the boom can be used to shield and protect the boom cylinder from damage when moving the backhoe against the sides of a trench or similar excavation.

The present backhoe is arranged to accommodate an overcenter movement of the boom cylinder when the boom is swung to a transport position. In the transport position, the backhoe has a generally vertically and slightly forwardly extending boom held locked in position by the boom cylinder which has gone through its overcenter position.

In the disclosed embodiments, a swing tower of cradle form is used to mount the boom asymmetrically relative to the vertical plane of symmetry of the swing tower. The boom cylinder is pivotally connected to one side of the swing tower so that the hydraulic actuator operating the boom flanks the boom. The swing tower provides sufficient space to accommodate the required forward travel of the boom relative to the boom cylinder. The ability of the boom to assume a more forward inclined relationship and the lower overall weight relative to conventional boom mounting arrangements affects an improvement in the position of the center of gravity and the handling characteristics of the machine when it is moved over the open road.

Two specific embodiments of the invention are described in detail. In one embodiment the main body of the boom is of conventional construction and is provided with a mounting means to position it asymmetrically relative to the center of the cradle section of the swing tower. As such the vertical plane through which the dipper stick and boom rotate is displaced a spaced distance from the vertical axis of rotation of the swing tower. In another embodiment a boom is used which incorporates a top piece so positioned and arranged relative to the longitudinal axis of the main body of the boom that the vertical plane through which the dipper stick rotates passes through the vertical axis of rotation of the swing tower. Effectively, the top piece corrects for the offset position of the lower end of the boom relative to the center of the cradle section of the swing tower. The cradle section is formed by the two generally vertical walls of the swing tower which are used to mount the boom. In both embodiments, the longitudinal axis of the hydraulic actuator or boom cylinders operating the boom is offset from the vertical plane passing through the vertical axis of the swing tower. Effectively, the hydraulic actuator in both designs incorporates a cylinder having a clevis at its lower end which fits around and is pivotally connected to one of the two vertical walls forming the cradle section of the swing tower. Finally, by using swing tower supports which locate the vertical axis of rotation asymmetrically relative to the center of the cradle section of the swing tower the offset of the boom can be corrected such that the dipper stick will pivot through the same vertical plane as the vertical axis of the swing tower.

A overcenter backhoe having an offset boom actuator and boom offers the following advantages over a backhoe of conventional design:

(1) better visibility of the bucket by the backhoe operator;

(2) reduced production costs since fewer parts are required;

(3) reduced weight and an improved center of gravity when the backhoe is in its transport position;

(4) improved stability when the backhoe is moved over the open road; and (5) a protected boom hydraulic actuator and thus increased freedom to operate the backhoe in confined areas where obstructions might damage an outwardly disposed hydraulic actuator.

Other advantages and features of the invention will be apparent from the following description, the claims and the drawings which show illustrative embodiments of the present invention.

DETAILED DESCRIPTION

Figure 1:
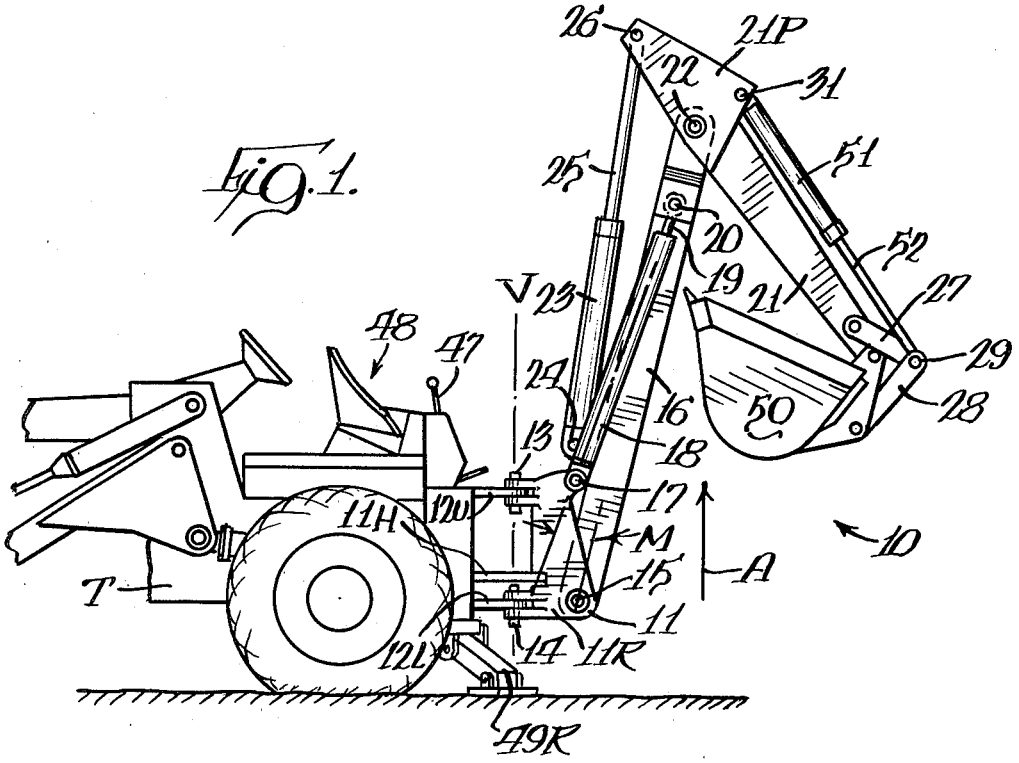
FIG. 1 is a side elevational view of the backhoe that is the subject of this invention illustrating the components in an intermediate position which corresponds to the normal transport position of an ordinary backhoe.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the specific embodiments illustrated.

Referring now to the drawings, a backhoe arrangement 10 is shown pivotally mounted upon the rear of a tractor which is illustrated only fragmentally as indicated at T. An operator's station 48 is located at the rear end of the tractor where a machinery operator or operating engineer sits to manipulate a set of controls 47.

The backhoe assembly includes a support attachment in the form of a swing tower 11 pivotally mounted to rearwardly projecting tractor mounting brackets 12U and 12L by means of upper and lower swivel pins 13, 14 which collectively define a common vertical axis V of rotation. The swing tower 11 carries a bottom horizontal pivot shaft 15 for pivotally mounting a boom 16 and an upper horizontal pivot shaft 17 for pivotally mounting a boom hydraulic actuator or boom cylinder 18. The boom cylinder 18 is of a double-acting type and has a single-ended piston rod 19 pivotally connected to a pivot shaft 20 located adjacent the free end of the boom 16. The specific arrangement of the boom 16, the swing tower 11, and the boom cylinder 18 will be described in detail at a later point in this discussion.

A dipper stick 21 is mounted on a pivot shaft 22 carried at the free end of the boom 16. This shaft defines the pivot axis for the dipper stick at a location intermediate its ends that is substantially closer to the boom end than the bucket end of the dipper stick. The dipper stick 21 includes a rigid attachment plate 21P, constituting its boom end, which is adapted to receive the pivot shaft 22. A single dipper stick cylinder 23, also of a double-acting type, is mounted on a pivot shaft 24 carried on the boom 16 adjacent its lower end. The dipper stick cylinder 23 has a single-ended piston rod 25 pivotally connected on a pivot shaft 26 carried at the end corner of the attachment plate 21P.

A bucket 50 is pivoted to the free end of the dipper stick in the conventional way. Specifically, a pair of drive links 27 and 28 are pivoted to the dipper stick 21 and to the bucket 50 respectively and are interconnected by a floating knee shaft 29. A bucket cylinder 51 of a double-acting type is mounted on a pivot shaft 31 carried on an upstanding corner of the dipper stick attachment plate 21P and has a single-ended piston rod 52 pivotally connected to the knee shaft 29. Finally, two stabilizer arms or outriggers 49R and 49L are provided to stabilize the backhoe 10 when the boom 16 is rotated about the vertical axis V of the swing tower 11.

In FIG. 1, the backhoe 10 is shown in an "intermediate position", which corresponds to the normal transport position for backhoes not having an "overcenter boom." In this configuration, the boom 16 extends generally vertically and rearwardly and the center of gravity of the backhoe parts is located along the vertical line indicated by an arrow "A", which in a typical prior art backhoe is 42.5 inches to the rear of the two vertical swivel pins 13 and 14. The boom cylinder 18 acts as a moment arm (as indicated at M) and hydraulic pressure must be applied to the piston rod end of the boom cylinder 18 to restrain the parts in the position shown in FIG. 1. In any event, the rearward location of the backhoe center of gravity affects the balance of the unit and makes handling more difficult, both during transport and in normal use.

Figure 3:
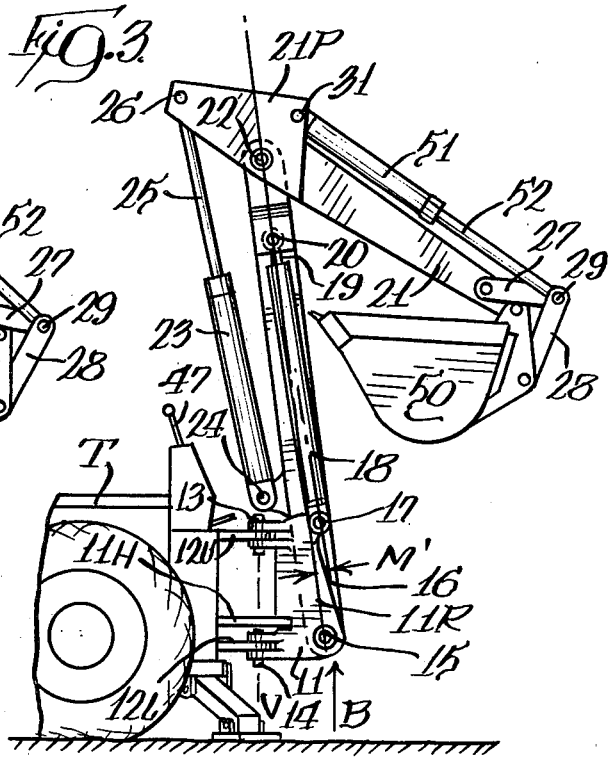
FIG. 3 is a side elevational view of the present backhoe showing the components in the improved transport position wherein the boom cylinder is overcenter relative to the boom to effect a knee lock action.

The present backhoe arrangement has a normal transport position is shown in FIG. 3, wherein the boom 16 extends generally vertically and slightly forwardly, and the center of gravity is located along the vertical line indicated by an arrow "B", which is about 20.0 inches to the rear of the vertical swivel pins 13 and 14. The boom cylinder 18 acts as a moment arm (as indicated at M') and application of hydraulic pressure to the piston end of the boom cylinder affects a "knee lock" joint to hold the parts in the position shown in FIG. 3. Balance and handling of the unit are greatly improved as the effective center gravity has been shifted forwardly by more than 50 percent. Now that the overall arrangement of the components has been described, the specific components that are the subject of the present invention will be described in greater detail.

Figure 4:
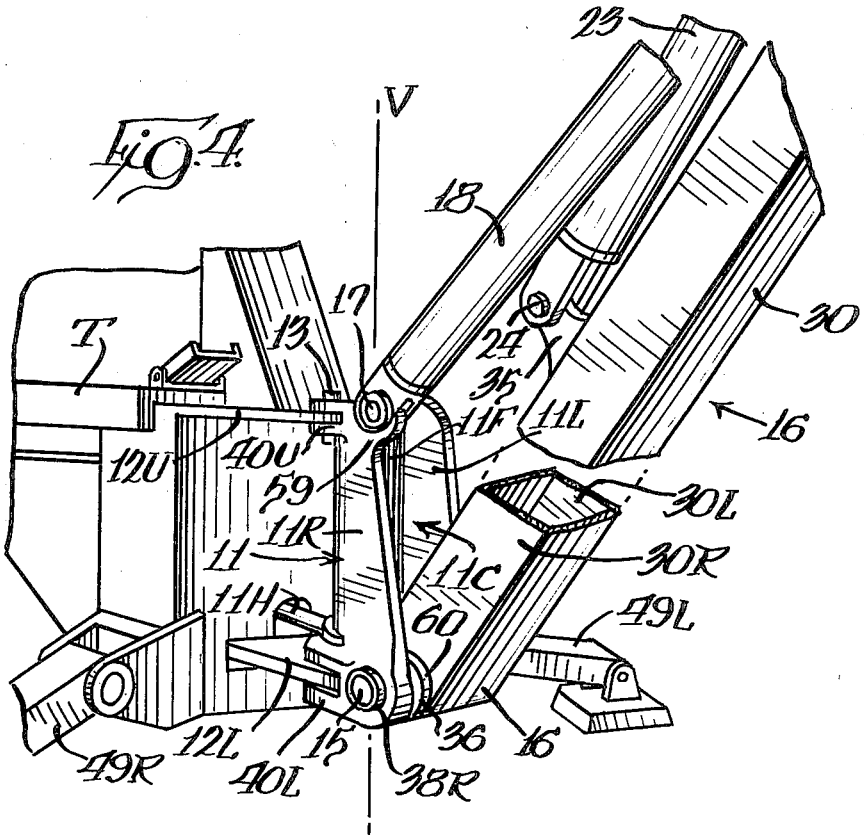
FIG. 4 is an enlarged fragmentary perspective view, partly in section, of the swing tower and boom mounting arrangement shown in FIGS. 1, 2, and 3.
Figure 5:
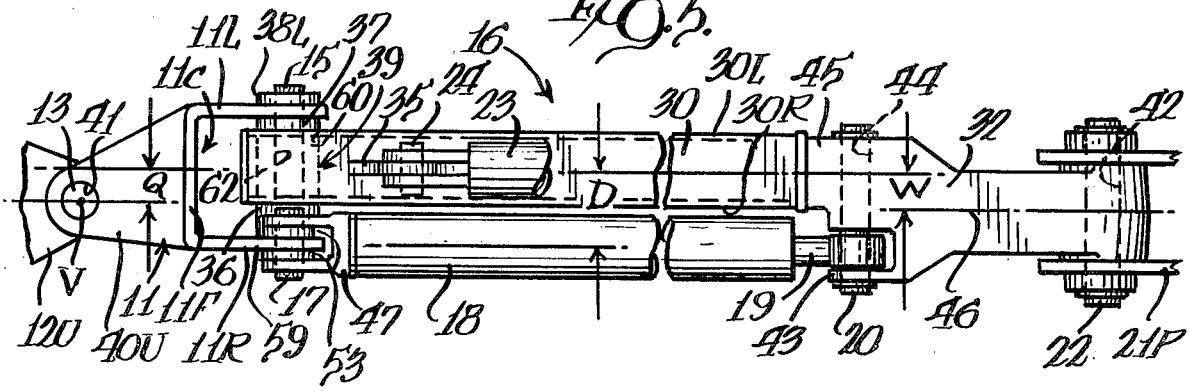
FIG. 5 is a foreshortened plan view showing the swing tower and boom mounting used in FIGS. 1, 2 and 3.
Figure 6:
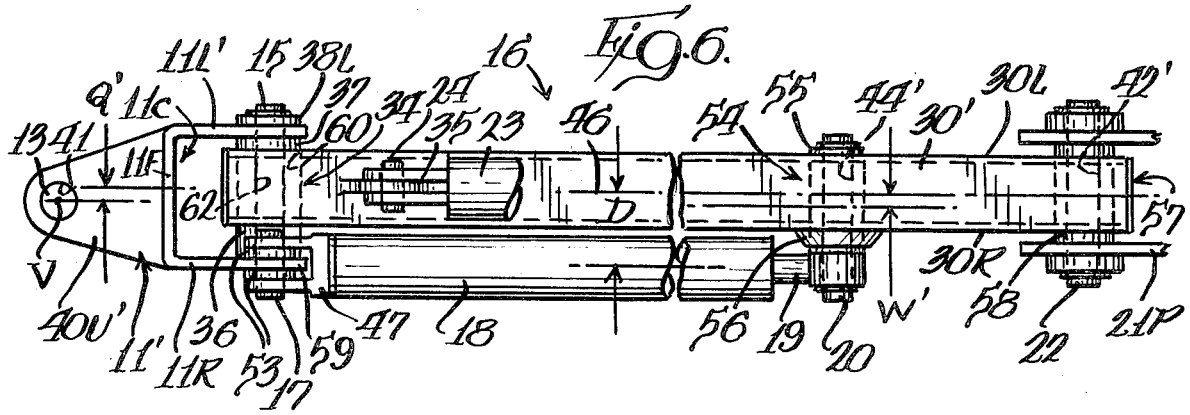
FIG. 6 is a foreshortened plan view showing another embodiment of the swing tower and boom mounting arrangement that is the subject of the present invention.

The swing tower 11 is a cradle-like structure (See FIG. 4) that is generally U-shaped in plan outline (See FIGS. 5 and 6). The swing tower 11 includes a vertical forward wall 11F and a pair of rearwardly projecting sidewalls 11R and 11L defining a channel space 11C in which the boom 16 is nestable. A swing cylinder 11H is used to rotate the swing tower 11. A pair of forwardly disposed ears or brackets 40U and 40L, through which the upper and lower swivel pins 13 and 14 pass, are used to mount the swing tower 11 on the tractor T. The lower rearward extremities of the sidewalls 11R and 11L serve as mounting sockets for the boom pivot shaft 15 and one (here 11R) upper rearward extremity of the sidewalls serves as a mounting socket for the boom cylinder 18 pivot shaft 17. This pivot shaft 17 is outboard to locate the boom cylinder 18 outboard of the swing tower 11 and enable the boom 16 to swing to a fully nested position within the channel space 11C (this being the preferred transport position as illustrated in FIG. 3).

Referring to FIG. 5, the plan view of the boom 16 and boom cylinder 18 is presented. The boom 16 is formed from three major parts or subsections: a generally hollow, rectangular box girder or main frame 30; a top piece 32 which joins the upper end of the main frame to the dipper stick attachment plate 21P and which couples the upper end of the boom cylinder 18 to the main frame of the boom; and a bottom mounting means 34 for pivotally connecting the main frame of the boom to the swing tower 11. Each of these components will now be described in detail.

The main frame 30 forms the common point of attachment for mounting and positioning the various moving components of the backhoe. As illustrated in the drawings, the main frame is generally rectangular in cross-section (i.e. see cut-away on FIG. 4) and is formed from a series of generally flat structural steel plates. One of the plates forming the main frame 30 of the boom 16 is disposed upwardly towards the backhoe operator or tractor driver and is used to mount a lug 35. The dipper stick cylinder 23 is pivotally connected by a pin 24 to this lug 35. Because the main frame 30 of the boom is the central point of attachment, it is by far the strongest structural member of the backhoe linkage.

The bottom mounting means 34 is used to pivotally connect the main frame 30 of the boom 16 with the swing tower 11. As illustrated in the drawings, the boom mounting means 34 defines a bore 60 between the two side walls 30R, 30L of the main frame 30 of the boom 16. Included in the bottom mounting means 34 are a series of bushings or spacers which are used to adjust the transverse position of the boom 16 between the two side walls 11L and 11R of the swing tower 11. In particular, one relatively long cylindrical bushing 36 is used to hold the right side wall 30R of the main frame 30 of the boom 16 at a spaced distance from the interior of one 11R of the side walls of the swing tower 11 in such a manner that the longitudinal axis of the main frame 30 of the boom 16 is held at a spaced distance Q from a vertical plane passing through the vertical axis of rotation V of the swing tower. Another spacer 37 is joined to the left side walls 30L of the main frame 30 of the boom 16. To facilitate mating the boom 16 to the swing tower 11, the bushing 36 and spacer 37 are preferably permanently joined to the two side walls 30R and 30L respectively, of the boom so that once the boom pivot pin 17 used to mount the boom to the swing tower 11 is inserted, the boom 16 will be properly positioned.

As illustrated in the drawings, the bottom mounting means can also be formed from a large cylinder or bushing 39 which spans across the two side walls 11L and 11R of the swing tower 11 and which fits within complementary apertures 60 defined in the two side walls 30L and 30R of the main frame 30 of the boom. In that configuration, the cylindrical walls of bushing are welded to the side walls of the boom. The bushing 39 defines an aperture or central bore 62 through which the boom pivot pin 15 fits. The exterior surfaces of the two swing tower side walls 11L and 11R can be "built up" or strengthened by adding a boss or collar 38R and 38L or additional plating. The boom pivot pin 15 fits within the reinforced side walls of the swing tower 11 and the central bushing 39 to which the main frame 30 of the boom is attached.

It should be appreciated from the foregoing description that the degree of offset Q between the vertical pivot axis V of the swing tower 11 and the longitudinal axis of the main frame 30 of the boom 16 is determined in part by the manner in which the ears 40U and 40L are disposed in relationship to the forward wall 11F of the swing tower. Specifically, FIG. 5 illustrates an upper support ear 40U defining an aperture 41, the center of which is offset from the center of the forward wall 11F of the swing tower. In FIG. 6 the support ears 40U' define an aperture 41, the center of which is centrally disposed between the two side walls 11R and 11L of the swing tower. Thus, for the same bottom mounting means 34 or mounting arrangement for connecting the lower end of the main frame 30 of the boom 16 to the swing tower 11, and for the same degree of offset of the longitudinal axis of the boom in relationship to side walls 11R and 11L of the swing tower, the degree of offset Q of the longitudinal axis of the boom relative to the vertical axis V of the swing tower in FIG. 5 is greater than the degree of offset Q' in FIG. 6.

At the upper end of the main frame 30 of the boom 16 the top piece is located. Referring to FIG. 5, the top piece 32 is a generally elongated one piece casting which serves three functions. It provides: a means for pivotally connecting the dipper stick 21 to the boom 16; a means for pivotally connecting the piston rod 19 of the boom actuator 18 to the boom; and a means for asymmetrically mounting or connecting the main frame 30 of the boom to the boom actuator 18 and dipper stick 21.

The upper end of the top piece 32 defines a central transverse bore 42 through which the dipper stick pivot pin 22 is fitted in joining dipper stick attachment plate 21P to the boom 16. As such, this method of mounting the dipper stick is conventional.

The lower end of the top piece 32 defines a clevis arm 43 and a central bore 44, the axis of which is parallel to the axis of the bore 42 at the other end of the top piece 32. A pivot pin 20 fitting through the bore 44 and clevis is used to connect the piston rod 19 of the boom actuator 18 to the top piece 32.

The lower end of the top piece 32 includes a fitting 45 which is complementary in shape to the cross-section of the main frame 30 of the boom 16. This fitting 45 is used to properly align the top piece relative to the main frame of the boom and to provide a convenient place for joining the top piece to the boom.

In FIG. 5 the longitudinal axis of the top piece 32 is offset from the longitudinal axis of the main frame 30 of the boom 16 by a distance W such that the longitudinal axis 46 of the top piece lies within a vertical plane passing through the vertical axis V of the swing tower 11. Thus, the top piece 32 effectively corrects for the asymmetric bottom mounting means 34.

The cylinder end of the boom hydraulic actuator 18 is provided with a clevis 47 which is used to pivotally connect the actuator to the swing tower 11. As illustrated in the drawings the upper end of the right side wall 11R of the swing tower 11 defines an ear 59 which is reinforced by a pair of collars 53. An aperture is provided in the ear and the collars which is complementary in shape to the aperture in the clevis 47 such that the boom actuator 18 can be pivotally connected to the swing tower 11. As such, the longitudinal axis of the boom actuator pivots through a vertical plane passing through the right side wall 11R of the swing tower 11.

Referring to FIG. 5, it should be noted that the distance D between the longitudinal axis of the main frame 30 and the longitudinal axis of the boom actuator 18 is generally less than the corresponding distance between the two side walls 11R and 11L of the swing tower 11. In one specific embodiment, a boom having a width of 5 inches was used with a boom actuator 18 having a width of 4.5 inches with a ½ inch space separating the right wall 30R of the main frame 30 of the boom from the exterior of the boom actuator. Thus, the bucket 50 is obscured by only 10 inches of structure. This is in contrast to the conventional mounting arrangement which usually has an overall width of approximately 15 inches or more. Thus, the overall width has been reduced by 33%.

FIG. 6 illustrates a second embodiment of the present invention. The boom 16' shown in FIG. 6 is somewhat more simplified than the boom 16 shown in FIG. 5. The main frame 30' is a generally box-like structure having two parallel side walls 30R and 30L to which are attached three separate and distinct pivotal connection means.

The lower end of the boom 16' illustrated in FIG. 6 uses a bottom mounting means 34 similar to that shown in FIG. 5. It should be recalled that the bottom mounting means there was a large cylindrical bushing which was welded to the side walls of the boom in such a manner that the longitudinal axis of the boom was offset from the vertical plane passing through the vertical axis V of the swing tower 11. Since the support ears 40U' defining the aperture 41 through which the upper and lower swivel pins 13 and 14 pass is asymmetrical relative to the two side walls 11R and 11L of the swing tower, the degree of offset Q' of the boom 16' in the embodiment illustrated in FIG. 6 is less than that offset Q of the boom 16 illustrated in FIG. 5.

At a position intermediate the upper and lower ends of the main frame 30' of the boom 16', a second pivotal connection means 54 is provided. As illustrated in FIG. 6, this pivotal connection means 54 includes a cylindrical bushing 55 defining a central horizontal aperture 44' through which the pivot pin 20 connecting the cylinder rod 19 of the boom actuator 18 is inserted. A collar 56 is welded to the right side wall 30R of the boom 16' to reinforce the connection between the bushing 55 and the main frame 30' of the boom.

Finally, a conventional pivotal connection means 57 is provided at the upper end of the boom 16' to connect the boom to the dipper stick 21. As in the case of the bottom mounting means 34 and the other pivotal connection means 54, a generally cylindrical bushing 58 is welded between the two side walls 30R and 30L of the main frame of the boom. This bushing 58 defines an aperture 42', the axis of which is parallel to the axis of the pivot pins 20 and 15 joining the boom to the boom cylinder 18 and the swing tower 11 respectively. It should be observed that since the main frame 30' of the boom 16' has a uniform cross-section, and since the main frame of the boom is asymmetrically positioned between the two side walls 11R and 11L of the swing tower, the dipper stick 21 joined to boom 16' of this embodiment will rotate through a vertical plane which is parallel to, but does not coincide with, the vertical axis V of the swing tower 11. As in the case of FIG. 5, the cylinder end of the boom hydraulic actuator 18 is pivotally connected to the swing tower 11 in such a manner that the longitudinal axis of the actuator rotates through the vertical plane defined by the right side wall 11R of the swing tower.

From the foregoing it should be appreciated that the distance D between the longitudinal axis of the boom and the longitudinal axis of the boom actuator 18 is the same as that distance in FIG. 5. Thus, the backhoe operator's view of the bucket 50 has been improved while employing a somewhat simpler boom design. Although the vertical plane through which the dipper stick 21 rotates when connected to the boom 16' illustrated in FIG. 6 does not pass through the vertical pivot axis V of the swing tower 11, the degree of offset W' is relatively small. Furthermore, the offset can be reduced, if not completely eliminated, by incorporating an asymmetric set of support ears 40U similar to those shown in FIG. 5. If this is done the vertical plane through which the dipper stick 21 and boom rotates can be made to coincide with the vertical axis V of the swing tower 11. Effectively, the asymmetric support ears 40U and 40L corrects for the offset of the boom 16' introduced by the bottom mounting means 34.

In the operation of the backhoe, normal loading is performed in the usual way. However, the boom 16 may operate more nearly towards a true vertical position to maintain the center of gravity of the backhoe closer to the swing tower 11 and improve the balance and handling characteristics. When the backhoe is finally being swung from the position shown in FIG. 1 to the position shown in FIG. 3 position, hydraulic pressure is applied to the rod end 19 of the boom cylinder 18 to swing the boom 16 to a true vertical position (See FIG. 2 wherein the line of action of the boom cylinder 18 registers with the center line of the boom) and then slightly forwardly of vertical (as represented in FIG. 3). The forward momentum of the parts enables the backhoe to continue through the FIG. 2 position towards the FIG. 3 position. Hydraulic pressure is applied at the piston end of the boom cylinder 18 to assist forward travel of the boom 16 from the FIG. 2 to the FIG. 3 position. Thereafter, the hydraulic pressure effects a "knee lock" on the boom to hold the backhoe in the transport position of FIG. 3.

Figure 2:
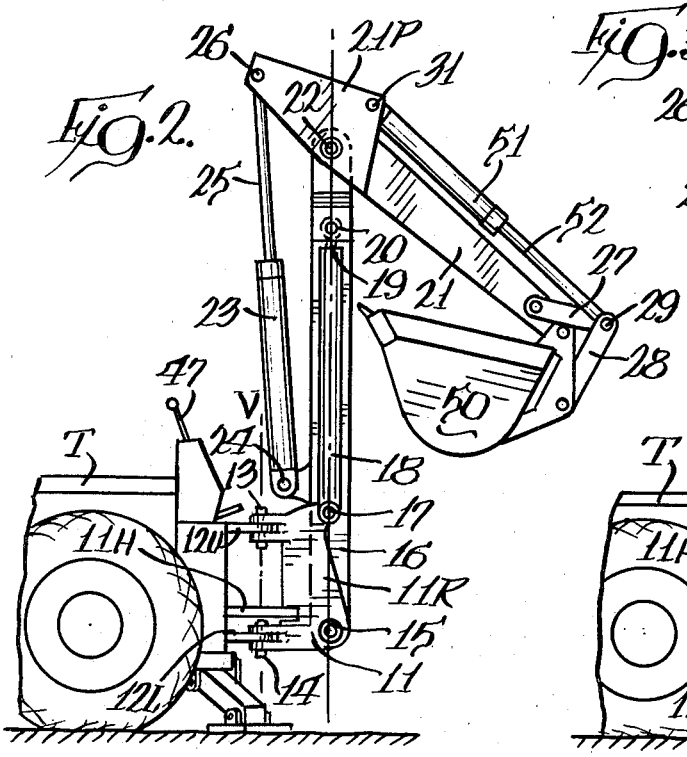
FIG. 2 is a side elevational view of the present backhoe showing the components in an intermediate position wherein the boom cylinder is aligned with the pivot axis of the boom.

It may be noted that the swing tower 11 mounts the boom cylinder pivot shaft 17 slightly forwardly of the boom pivot shaft 15 such that in the neutral position of FIG. 2 (wherein the center line of the boom 16 is in registry with the line of action of the boom cylinder 18) the boom leans slightly forwardly of true vertical position. This provides more positive control assisting the forward momentum in insuring that the backhoe swings "overcenter" to enable hydraulic pressure to actuate the boom cylinder in a direction to assist the final forward increment of travel.

To shift the backhoe from the FIG. 3 position towards the FIG. 1 position, hydraulic pressure is applied at the rod end of the boom cylinder 18 to initiate rearward swinging movement of the boom 16. The bucket cylinder 51 is operated at the same time to curl the bucket 50 rearwardly, thereby abruptly shifting the center of gravity to the rear and assisting in the rearward "launch" of the boom. When the parts move through the FIG. 2 position to the FIG. 3 position, the hydraulic pressure is relieved from the rod end of the boom cylinder 18.

Thus, two specific backhoe embodiments have been discussed in detail and illustrated in the drawings which provide for improved operator visibility, reduced operating and maintenance cost, reduced weight, improved stability, and a way to operate a backhoe in close quarters or in areas where obstructions might damage the relatively weak boom actuator. While the invention has been described in conjunction with certain specific embodiments, it is evident that many alternatives, modifications, and variations will be apparent to those skilled in the art in light of the foregoing description. Accordingly, it is intended to cover all such alternatives, modification, and variations as set forth within the spirit and broad scope of the appended claims.

What is claimed is as follows:

1. In a backhoe arrangement, comprising: a swing tower having a forward wall defining lower rearward extremities mounting a boom pivot shaft, and an upper rearward extremity mounting a boom actuator pivot shaft; a boom having its lower end pivotally mounted on said boom pivot shaft asymmetrically relative to said lower rearward extremities and free to swing forwardly and rearwardly of its true vertical position; a dipperstick carried at the upper end of said boom; and one boom hydraulic actuator means, pivotally mounted at one of its ends on said boom actuator pivot shaft to flank said boom and pivotally connected at its other end to said boom, for pivotally rotating said boom through a vertical plane, whereby the free end of said dipperstick is minimally obscured by said boom.

2. The backhoe arrangement set forth in claim 1, wherein the axis of said boom actuator pivot shaft is forward of said boom pivot shaft and said boom is swingable far enough forwardly to enable extension of said boom hydraulic actuator means to effect a knee lock hold of said boom forwardly against said swing tower forward wall thereby defining a positive lock for said boom.

3. The backhoe arrangement set forth in claim 1, wherein said swing tower is rotatable about a vertical axis and said lower rearward extremities are asymmetrically disposed relative to a plane passing through the vertical pivot axis of the swing tower, and said boom is disposed asymmetrically between said lower rearward extremities such that the boom rotates through said vertical plane.

4. A backhoe arrangement, comprising: a vertically extending swing tower having vertically spaced mounting portions projecting rearwardly therefrom and carrying upper and lower pivot means, rearwardly offset from each other, for pivotally connecting parallel upper and lower horizontal pivot shafts, said upper pivot means being asymmetrically disposed relative to said lower pivot means; an asymmetrically mounted boom pivoted on said lower pivot shaft for pivotal movement through a neutral intermediate position where it extends substantially vertically to intersect said upper pivot means; and one double-acting boom cylinder mechanism mounted on said upper pivot shaft and pivoted to said boom to extend alongside the same and define a line of action in registry with said boom at the neutral position thereof, said double-acting boom cylinder mechanism being extendable to effect swinging movement of the boom and of the cylinder mechanism to either side of said neutral intermediate position.

5. In an earth-moving apparatus of the type including a fixed support, a swing tower pivotally connected to said support and free to rotate about a vertical axis, a boom pivotally connected at its lower end to the lower end of said swing tower and free to rotate about a horizontal axis between raised and lowered positions and adapted to carry at its upper end a horizontally pivotally connected implement, and a hydraulic actuator pivoted at one of its ends to said swing tower about a horizontal axis and pivoted at its other end to a horizontal axis on said boom at a position intermediate the ends of said boom, said boom, comprising:

(a) a generally elongated main frame having an upper end and a lower end;

(b) bottom mounting means, joined to the lower end of said frame, for asymmetrically and pivotally connecting said frame to the lower end of said swing tower, said frame being joined to said bottom piece in such a manner that the longitudinal axis of the frame is at a spaced distance from a vertical plane passing through the vertical pivot axis of said swing tower and the sides of said frame are in a clearance relationship with respect to the hydraulic actuator, and (c) an elongated top piece having one of its ends joined to the upper end of said frame, having at its opposite end top means for pivotally connecting said implement to said top piece, and having middle means for pivotally connecting the other end of said hydraulic actuator to said frame, whereby said actuator flanks said frame and is protected by it.

6. The apparatus set forth in claim 5, wherein said swing tower defines at least one generally vertical rearward extending wall paralleling the vertical plane through which the boom rotates, and wherein said one end of said hydraulic actuator is pivoted to said vertical wall.

7. The apparatus set forth in claim 6, wherein said swing tower defines a second vertical wall parallel to said first wall, said boom being disposed asymmetrically between said walls by said bottom mounting means and free to rotate within the channel defined by said two vertical walls.

8. The apparatus set forth in claim 7, wherein the top piece includes fitting means, at said one end, for asymmetrically mounting the top piece to the upper end of the frame, and wherein said middle means is disposed adjacent said one end of said top piece, said fitting means and said middle means being positioned relative to the longitudinal axis of the top piece and said two vertical walls such that the longitudinal axis of the top piece lies in the vertical plane passing through the vertical pivot axis of the swing tower, whereby said implement pivots in the same vertical plane as that passing through the vertical axis of the swing tower while improving the operator's view of the free end of the implement.

9. The apparatus set forth in claim 7, wherein said swing tower is pivotally connected to said support by a pair of vertically spaced brackets which are horizontally disposed between the two vertical walls of the swing tower and oppositely thereto, said brackets defining the vertical pivot axis of the swing tower.

10. The apparatus set forth in claim 9, wherein the vertical axis of the swing tower is disposed asymmetrically between the two vertical walls of the swing tower such that vertical plane through which the implement rotates passes through the vertical pivot axis of the swing tower.

* * * * *